US009868306B2

(12) United States Patent
Sakano et al.

(10) Patent No.: US 9,868,306 B2
(45) Date of Patent: Jan. 16, 2018

(54) TAPE CARTRIDGE

(71) Applicant: Seiko Epson Corporation, Tokyo (JP)

(72) Inventors: Hideki Sakano, Suwa (JP); Akihiro Shintani, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/128,423

(22) PCT Filed: Mar. 19, 2015

(86) PCT No.: PCT/JP2015/058315

§ 371 (c)(1),
(2) Date: Sep. 22, 2016

(87) PCT Pub. No.: WO2015/146795

PCT Pub. Date: Oct. 1, 2015

(65) Prior Publication Data

US 2017/0106679 A1 Apr. 20, 2017

(30) Foreign Application Priority Data

Mar. 24, 2014 (JP) ..... 2014-060914

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 13/0009; B41J 13/00; B41J 15/046; B41J 15/044; B41J 15/04; B41J 15/00; B41J 2/32; B41J 15/048; B41J 15/16; B41J 11/42; B41J 11/0095; B41J 13/0027
See application file for complete search history.

(56) References Cited

U.S. PATENT DOCUMENTS

| | | | |
|---|---|---|---|
| 6,130,695 | A | 10/2000 | Childers et al. |
| 2013/0089366 | A1 | 4/2013 | Kosuge |
| 2015/0124041 | A1 | 5/2015 | Kosuge |
| 2016/0214416 | A1 | 7/2016 | Kosuge |

FOREIGN PATENT DOCUMENTS

| | | |
|---|---|---|
| CN | 102295197 A | 12/2011 |
| JP | S56-0013193 | 2/1981 |
| JP | 2008-194916 | 8/2008 |
| JP | 2008-263545 | 10/2008 |
| JP | 2013-141749 | 7/2013 |

OTHER PUBLICATIONS

Search Report recieved in International Application No. PCT/JP2015/058315, dated Jun. 9, 2015.

*Primary Examiner* — Kristal Feggins
(74) *Attorney, Agent, or Firm* — ALG Intellectual Property, LLC

(57) ABSTRACT

A tape cartridge is detachably installed on a tape printing apparatus provided with a detection portion which detects attribute information of the tape cartridge installed on a cartridge installation portion on which the tape cartridge is installed. The tape cartridge includes a wound printing tape and a core shaft. In the tape cartridge, the core shaft is positioned at an inner peripheral side of the wound printing tape, and the core shaft includes a detection object which faces the detection portion when the tape cartridge is installed on the tape printing apparatus.

20 Claims, 13 Drawing Sheets

TAPE CARTRIDGE

CROSS-REFERENCE TO RELATED APPLICATIONS

This application is the U.S. National Phase under 35 U.S.C. §371 of International Application No. PCT/JP2015/058315 filed on Mar. 19, 2015, which in turn claims the benefit of Japanese Application No. 2014-060914 filed on Mar. 24, 2014, the disclosures of which are expressly incorporated by reference herein.

TECHNICAL FIELD

The present invention relates to a tape cartridge that is detachably installed on a tape printing apparatus in which a detection portion is provided in a cartridge installation portion to detect attribute information of the tape cartridge.

BACKGROUND ART

Up until now, a tape cassette having a concave space corresponding to a sensor support portion formed in a cassette installation portion of a print label forming apparatus has been known as such a tape cartridge (see JP-2013-141749).

In a cassette installation portion of the print label forming apparatus, a transport mechanism or a printing mechanism that performs printing on a tape drawn from a tape cassette is disposed and two positioning pins disposed to be separated from each other are erected. In the cassette installation portion, a prismatic sensor support portion is erected in which a plurality of sensors that detect attribute information regarding the tape (film tape) are incorporated. In the sensor support portion, four vertical reflective sensors are provided on the front surface and four vertical reflective sensors are similarly provided on the right surface.

On the other hand, the tape cassette includes an adhesive tape spool that winds a double-sided adhesive tape, a film tape spool that winds a film tape (printing tape), a ribbon spool that winds an ink ribbon, a ribbon winding-up spool that winds up an ink ribbon, a tape driving roller, and a cassette case that accommodates the spools and the tape driving roller. In the cassette case, two pin holes corresponding to the two positioning pins are formed and a concave space corresponding to the sensor support portion is formed in a space between the double-sided adhesive tape and the film tape. Further, a total of eight black-painted detection objects corresponding to the reflective sensors are provided on a peripheral wall forming the concave space.

SUMMARY

In such a tape cassette of the related art, the two pin holes corresponding to the two positioning pins and the concave space corresponding to the sensor support portion are provided at separate positions. Therefore, there is a concern of the concave space being subtly deviated in position from the sensor support portion when the tape cassette is installed. Therefore, there is a problem that detection of the attribute information regarding the film tape is unstable. However, when the sensor support portion or the concave space is enlarged and the sensor intervals are sufficient, such a problem is resolved. Then, however, the print label forming apparatus or the tape cassette has to be increased in size.

Alternatively, from the viewpoint of a space, it is necessary to decrease the winding numbers of the double-sided adhesive tapes or the film tapes.

An object of the present invention is to provide a tape cartridge capable of achieving stability of detection by a detection portion while suppressing an increase in size.

A tape cartridge of the present invention is a tape cartridge detachably installed on a tape printing apparatus provided with a detection portion which detects attribute information of the tape cartridge installed on a cartridge installation portion on which the tape cartridge is installed. The tape cartridge is characterized by including a wound printing tape and a core shaft, wherein the core shaft is positioned at an inner peripheral side of the wound printing tape, and when the tape cartridge is installed on the tape printing apparatus, a detection object facing the detection portion is provided in the core shaft.

In this case, preferably, when the tape cartridge is installed on the tape printing apparatus, the detection object engages with the detection portion.

In this case, preferably, the detection object and the detection portion elastically engage with each other.

Since the inner periphery of the wound printing tape has a relatively large diameter in order to suppress peculiar winding of the printing tape, the core shaft disposed at the inner periphery also has a relatively large diameter.

With such a configuration, the detection object provided on the relatively large core shaft can be also relatively large. Accordingly, even though a minute displacement occurs in the tape cartridge installed in the cartridge installation portion, the detection of the attribute information of the tape cartridge is stably operated without damaging the detection performance of the tape detection portion. In general, it is possible to effectively utilize the inner periphery of the printing tape which is a dead space, and to suppress an increase in size.

In this case, preferably, with respect to the detection portion incorporated into a convex portion provided projectingly at the cartridge installation portion, the core shaft includes a concave portion into which the convex portion is inserted in a state where the tape cartridge is installed on the cartridge installation portion, and the detection object is incorporated into the concave portion.

With such a configuration, it is possible to increase the degree of freedom in arrangement of the detection object in the peripheral direction of the core shaft, and even in this regard, it is possible to stably detect attribute information of the tape cartridge.

In this case, preferably, with respect to the convex portion including a first convex portion on a tip end side and a second convex portion on a base end side into which the detection portion is incorporated, the concave portion includes a first concave portion that is fitted into the first convex portion and a second concave portion that faces the second convex portion and is incorporated with detection object.

With such a configuration, the first concave portion of the concave portion is fitted into the first convex portion of the convex portion, and thus it is possible to position the concave portion relative to the convex portion. Accordingly, it is possible to perform positioning relative to the cartridge installation portion as a whole, and to stably detect attribute information of the tape cartridge at the same time.

Preferably, with respect to the detection portion that includes a plurality of conductive contacts connected to a detection circuit of binarized attribute information, the detection object includes a plurality of contact terminals including a contact portion coming in contact with the plurality of conductive contacts and a conductive/non-conductive wiring portion that is connected to the plurality of contact terminals.

With such a configuration, there is a structure in which the plurality of contact terminals (contact portions) of the detection object come in physical contact with the plurality of conductive contacts of the detection portion, and thus it is possible to reliably detect attribute information of the tape cartridge.

In this case, preferably, the detection object includes a wiring pattern substrate provided with the plurality of contact terminals and the conductive/non-conductive wiring portion, and the wiring pattern substrate is flexible.

With such a configuration, the detection object can be smoothly incorporated into the concave portion of the core shaft. That is, even when manufacturing tolerance exists in the concave portion of the core shaft, the detection object can be appropriately incorporated into the concave portion.

In this case, preferably, with respect to the detection portion incorporated into the convex portion provided projectingly at the cartridge installation portion, the core shaft includes a concave portion into the convex portion is inserted when the tape cartridge is installed on cartridge installation portion, and the wiring pattern substrate is disposed at an inner peripheral side of the core shaft constituting the concave portion.

In this case, preferably, the wiring pattern substrate is disposed at the inner peripheral side of the core shaft constituting the concave portion such that the plurality of contact terminals are located at an inner side.

With such a configuration, it is possible to dispose the wiring pattern substrate having a sufficient area in the concave portion in terms of good space efficiency. The wiring pattern substrate is preferably disposed along the inner peripheral surface of the concave portion.

Preferably, the detection object further includes a cylindrical substrate cover that covers the wiring pattern substrate, and the substrate cover is formed with a plurality of through-holes that allows each of the conductive contacts to come in contact with each of the contact terminals.

With such a configuration, it is possible to appropriately protect the wiring pattern substrate without affecting the contact of each conductive contact with each contact terminal.

In this case, preferably, the wiring pattern substrate is attached to an outer peripheral surface of the substrate cover.

With such a configuration, it is possible to be incorporated into the core shaft by integrating the wiring pattern substrate and the substrate cover with adhesion or the like, and to improve productivity.

Meanwhile, preferably, the substrate cover is installed on the inner peripheral surface of the core shaft in a form of snap-in.

With such a configuration, the substrate cover can be simply installed on the core shaft, and productivity can be improved.

In this case, preferably, the substrate cover is formed with a hook for the snap-in, and the wiring pattern substrate includes a notched concave portion in a portion corresponding to the hook.

In addition, preferably, the substrate cover is formed with a hook for the snap-in, and in the inner peripheral surface of the core shaft, a hook receiving portion having a width corresponding to that of the hook is formed.

With such a configuration, the substrate cover is aligned with the core shaft through the hook in the peripheral direction, and the wiring pattern substrate is aligned with the substrate cover through the notched concave portion. Thus, the respective contact terminals of the wiring pattern substrate and the respective conductive contacts of the detection portion can be appropriately aligned with each other in the peripheral direction.

Meanwhile, preferably, with respect to the plurality of conductive contacts disposed at equal intervals in a peripheral direction relative to the convex portion provided projectingly at the cartridge installation portion, the plurality of contact portions of the plurality of contact terminals are disposed at equal intervals in the peripheral direction.

With such a configuration, it is possible to respectively dispose the plurality of conductive contacts and the plurality of contact portions at appropriate intervals, and to increase the number of conductive contacts and contact portions. Accordingly, it is possible to achieve stability of the detection and to increase the amount of attribute information of the tape cartridge.

Furthermore, preferably, the detection object further includes a cylindrical substrate cover that covers the wiring pattern substrate, and with respect to the plurality of conductive contacts having spring properties, the substrate cover includes an annular projection in which the plurality of conductive contacts relatively get over while being elastically deformed.

With such a configuration, it is possible to provide appropriate click feeling at the time of installation on the cartridge installation portion, and to effectively prevent an installing defect.

In this case, preferably, the annular projection has a tip end that is formed in a chamfered shape.

With such a configuration, it is possible to press the substrate cover against the cartridge installation portion using a spring force of the plurality of conductive contacts. Therefore, it is possible to also prevent the tape cartridge from floating.

In addition, preferably, the conductive/non-conductive wiring portion of the wiring pattern substrate includes a plurality of individual wiring portions that are respectively connected to the contact terminals and a common wiring portion through which the plurality of individual wiring portions are connected to each other, and the attribute information is configured by conduction/non-conduction of the plurality of individual wiring portions.

With such a configuration, it is possible to configure attribute information of the tape cartridge by a simple wiring pattern.

In this case, preferably, the non-conduction is configured by partially removing a desired individual wiring portion from the plurality of patterned individual wiring portions.

With such a configuration, it is possible to configure attribute information of the individual tape cartridge from the common wiring pattern.

In addition, preferably, an electronic device is disposed on the wiring pattern substrate.

With such a configuration, it is possible to remarkably increase the amount of attribute information of the tape cartridge.

DESCRIPTION OF EXEMPLARY EMBODIMENTS

Hereinafter, a description will be given, with reference to the accompanying drawings, of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
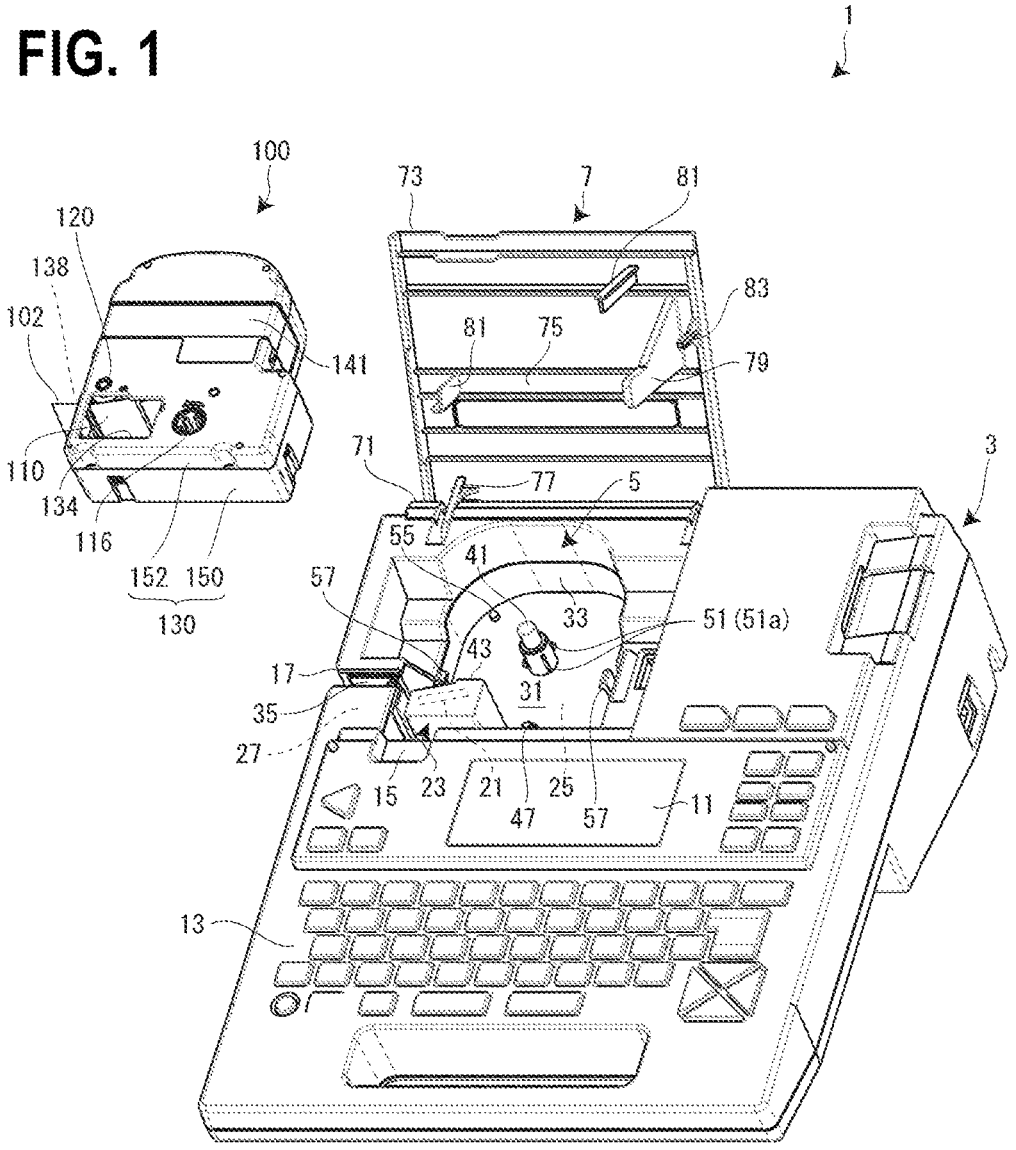
FIG. 1 is an external perspective view of a cover open condition of a tape printing apparatus according to an embodiment.

FIG. 1 is an external perspective view of the tape printing apparatus and the tape cartridge installed in the tape printing apparatus. As illustrated in the same figure, a tape printing apparatus 1 includes an apparatus casing 3 constituting an outer shell, a cartridge installation portion 5 on which a tape cartridge 100 is detachably installed, and an opening/closing cover 7 used to open/close the cartridge installation portion 5. At the upper surface of the apparatus casing 3, the cartridge installation portion 5 is provided on the back side, a display 11 is provided on the central side, and a keyboard 13 is provided on the front side. In the vicinity of the opening/closing cover 7, a finger-hooking recessed portion 15 is provided. The opening/closing cover 7 is opened so as to be flipped up through the recessed portion 15. On the side surface (left side surface) of the apparatus casing 3, an elongated tape ejection port 17 is provided to eject a printing tape 102.

In addition, the tape printing apparatus 1 includes a printing mechanism portion 23 having a printing head 21 provided uprightly on the cartridge installation portion 5, a tape feeding mechanism portion 25 embedded in the back side space of the cartridge installation portion 5, and a tape cutting mechanism portion 27 embedded in the vicinity of the tape ejection port 17. A user inputs printing information using the keyboard 13 and performs printing with a key operation after confirming the printing information on the display 11. Upon the printing instruction, the tape feeding mechanism portion 25 is driven to make the printing tape 102 and the ink ribbon 110 run parallel to each other, and printing is performed by heat transfer from the printing mechanism portion 23. By the print feeding, the printing tape 102 is ejected from the tape ejection port 17. When the printing is completed, the tape cutting mechanism portion 27 is driven, whereby a printed part of the printing tape 102 is separated.

[Outline of Tape Cartridge]

As illustrated in FIGS. 2A and 2B and FIGS. 5A and 5B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 through the printing tape 102 and the ink ribbon 110 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134, into which the printing head 21 is inserted when the tape cartridge is installed in the tape printing apparatus 1, on the cartridge casing 130. The tape cartridge 100 includes a delivered 138 that is formed on the cartridge casing 130 and from which the printing tape 102 is delivered. Note that as will be described in detail below, the tape roll 106 is rotatably supported on a cylindrical core shaft 192 projecting inside the cartridge casing 130 (see FIG. 5A).

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the delivered 138 to the tape ejection port 17. On the other hand, the ink ribbon 110 goes around the peripheral wall part of the insertion opening 134 and is wound up on the winding-up core 116. Note that a plurality of types of tape cartridges having a different thickness is available as the tape cartridge 100 according to a tape width of the printing tape 102.

[Details of Tape Printing Apparatus]

Figure 3:
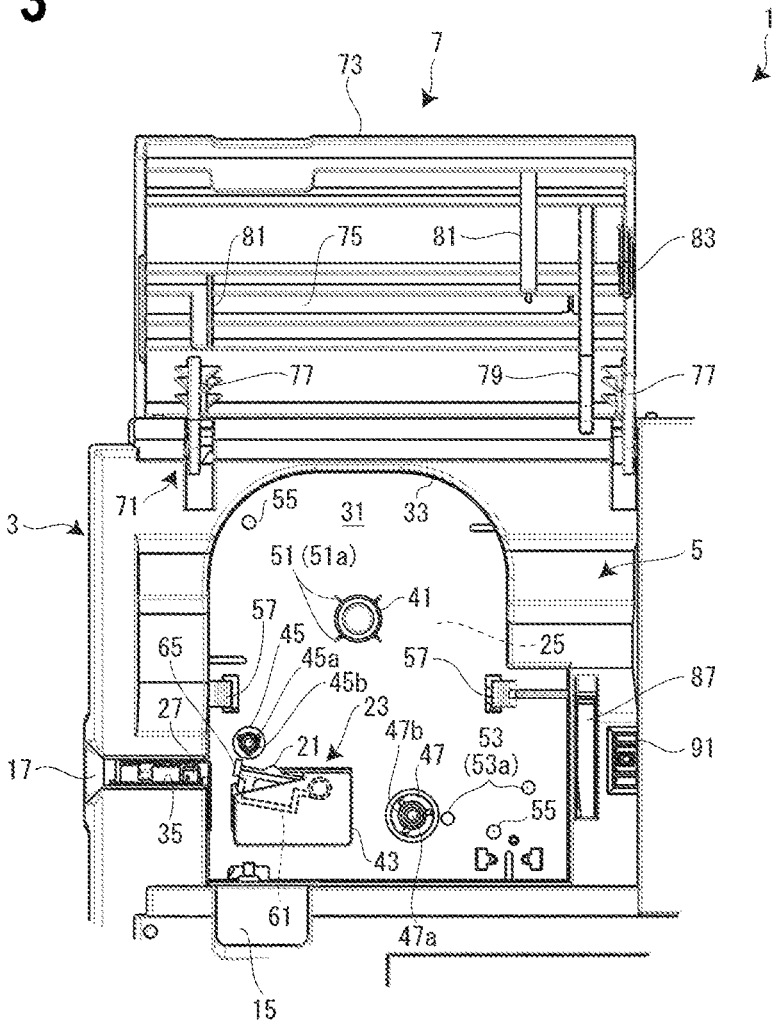
FIG. 3 is a plan view of a cartridge installation portion.

As illustrated in FIGS. 1 and 3, the cartridge installation portion 5 is formed in a flat shape complementary to the flat shape of the tape cartridge 100 and formed to be recessed with a depth corresponding to the tape cartridge 100 having a maximum thickness among the plurality of types of installable tape cartridges 100. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this part.

In the installation base 31 of the cartridge installation portion 5, when the tape cartridge 100 is installed, a positioning projection 41 (convex portion) into which the inner periphery (concave portion) of the core shaft 192 (see FIGS. 5A and 5B) of the tape cartridge 100 is fitted and positioned, the printing head 21 covered with the head cover 43, a platen driving shaft 45 that rotates and drives the platen roller 120, a winding-up driving shaft 47 that rotates and drives the winding-up core 116 are provided uprightly. In addition, the detection portion 51 is incorporated into the positioning projection 41 to detect a type (attribute information) of the tape cartridge 100 (the details will be described below).

Meanwhile, the installation base 31 is provided with a core releasing portion 53 that is positioned in the vicinity of the winding-up driving shaft 47 to release the rotation stop of the feeding-out core 112 and the winding-up core 116. Furthermore, the installation base 31 is provided with a pair of small projections 55 at positions diagonal to each other, and is additionally provided with a pair of retaining pieces 57 that retain an intermediate portion of the installed tape cartridge 100.

In the back side space of the installation base 31, the tape feeding mechanism portion 25 having a motor and a gear train (both of them is not illustrated in the drawings) to rotate the platen driving shaft 45 and the winding-up driving shaft 47 is embedded. The tape feeding mechanism portion 25 branches power using the gear train, and synchronously rotates the platen driving shaft 45 and the winding-up driving shaft 47. Although not illustrated in the drawings, a detection circuit connected to the detection portion 51 or a control substrate mounted with a control circuit for controlling the printing mechanism portion 23, the tape feeding mechanism portion 25, and the like is embedded in the back side space of the key board 13.

The printing mechanism portion 23 includes the printing head 21 constituted of a thermal head and a head support frame 61 that supports and rotates the printing head 21. In addition, the printing mechanism portion 23 includes a head releasing mechanism (not illustrated) that rotates the printing head 21 between a printing position and a retracting position via the head support frame 61 and the head cover 43 that covers the printing head 21 (and the head support frame 61).

The head releasing mechanism operates as the opening/closing cover 7 is opened/closed. The head releasing mechanism moves (rotates) the printing head 21 to the printing position according to the closing operation of the opening/closing cover 7 and moves (rotates) the printing head 21 to the retracting position according to the opening operation thereof. The printing head 21 comes in contact with the platen roller 120 of the tape cartridge 100 via the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached to or detached from the tape printing apparatus 1.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven. The head cover 43 is formed in a substantially rectangle shape in plan view and integrally formed (molded) with the installation base 31 (the cartridge installation portion 5). In addition, the head cover 43 vertically largely projects from the installation base 31. The head cover 43 internally allows the rotation of the printing head 21 and externally functions as an installation guide for the tape cartridge 100.

The tape detection portion 51 is constituted of a plurality of conductive contacts 51*a* which will be described later. The tape detection portion 51 is selectively electrically connected with a detected portion 180 of the tape cartridge 100, and detects mainly a type (attribute information) such as a tape width, a tape color, and a material of the printing tape 102. Further, based on the detection result, the driving of the printing head 21 and the tape feeding mechanism portion 25 is controlled.

The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a fixation shaft 45*a* provided so as to insert the platen roller 120, and a spline-shaped movable shaft 47*a* rotatably journaled in the base of the fixation shaft 45*a*. The rotation power of the tape feeding mechanism portion 25 is transmitted to the movable shaft 45*b* and then further transmitted to the platen roller from the movable shaft 45*b*. Similarly, the winding-up driving shaft 47 includes a fixation shaft 47*a* and a spline-shaped movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41 (see FIG. 9), the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
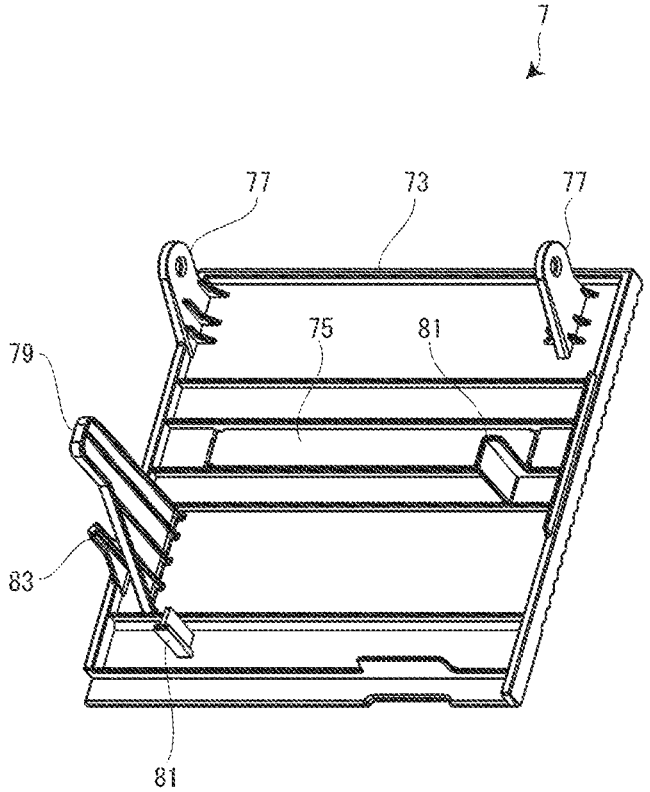
FIG. 4 is a perspective view of an opening/closing cover when viewed from a back side.

As illustrated in FIGS. 1 and 4, the opening/closing cover 7 is rotatably, i.e., openably/closably attached to the apparatus casing 3 via a hinge portion 71 provided on the back side. The opening/closing cover 7 includes an opening/closing cover main body 73 and a check window 75 provided at the center of the opening/closing cover main body 73. In addition, opening/closing cover 7 includes a pair of journaled pieces 77 that projects from the rear surface of the opening/closing cover main body 73 and is rotatably journaled in the hinge portion 71 and an operation lever 79 that projects from the rear surface of the opening/closing cover main body 73 and rotates the printing head 21. Moreover, the opening/closing cover 7 includes two pressing projections 81 that project from the rear surface of the opening/closing cover main body 73 and press the tape cartridge 100 and a pressing projection 83 that projects from the rear surface of the opening/closing cover main body 73 and operates (turns ON) an embedded cover closing detection switch (not illustrated).

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of journaled pieces 77, the operation lever 79, the pressing projections 81, and the pressing projection 83 are integrally formed (molded) with the opening/closing cover main body 73 by a resin.

The operation lever 79 largely projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate forward the platen roller 120. Similarly, as the opening/closing cover 7 is closed, the pressing projection 83 is inserted in a rectangle opening 91 adjacent to the slit opening 87 to operate (turn "ON") the cover closing detection switch.

One of the pressing projections 81 is positioned so as to be in the vicinity of the platen roller 120 of the tape cartridge 100, and the other of the pressing projections 81 is positioned immediately above the detection portion 51. Two pressing projections 81 press the tape cartridge 100 so as to be set on the installation base 31 of the cartridge installation portion 5 with the closing of the opening/closing cover 7, and prevents the tape cartridge 100 from floating.

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, taking FIGS. 2A and 2B as an example, a surface on the near side in the installation direction, i.e., on the upper front side of the tape cartridge 100 will be called a "front surface," a surface on the back side in the installation direction, i.e., on the opposite side of the tape cartridge 100 will be called a "rear surface," a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface.

As described above, the tape cartridge 100 includes the cartridge casing 130 and the tape roll 106, the ribbon roll 114, the winding-up core 116, and the platen roller 120 accommodated in the cartridge casing 130. In addition, the tape cartridge 100 includes the insertion opening 134 provided on the cartridge casing 130, the delivered 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, a tape width, a tape color, a material, and the like (some of attribute information) of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a transparent resin molded item, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall portion 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall portion 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 2A:
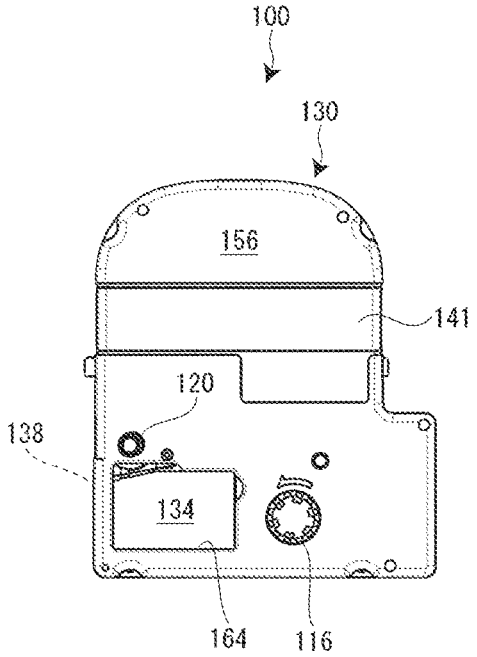
FIGS. 2A and 2B are a plan view and a side view of a tape cartridge according to the embodiment.
Figure 2B:
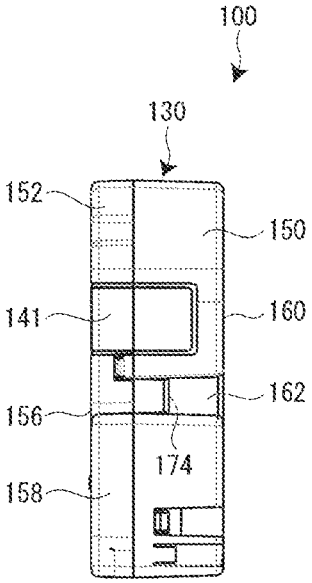
Figure 6:
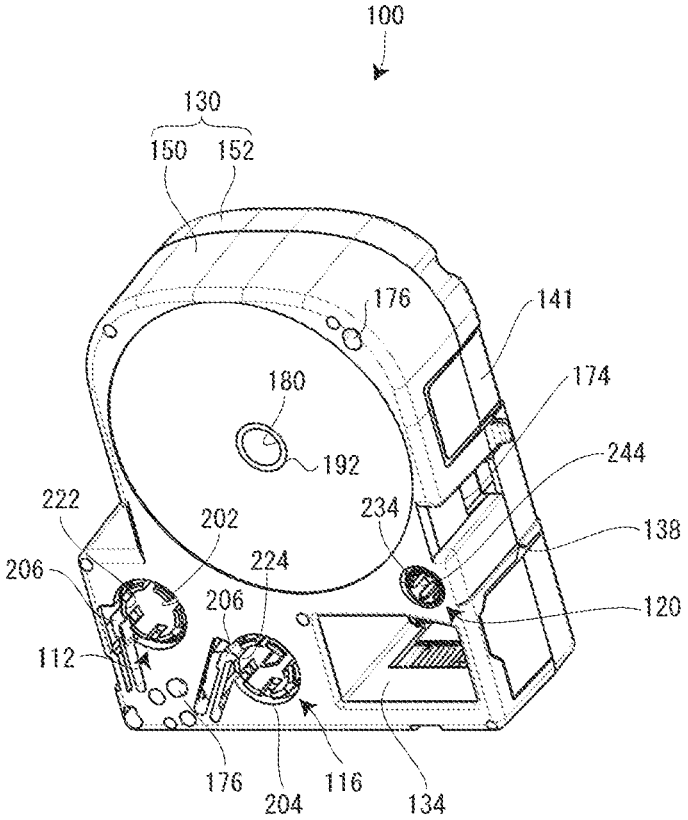
FIG. 6 is a perspective view of the tape cartridge when viewed from the back side.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base 31.

As illustrated in FIG. 5, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface 192*b* of the core shaft. That is, the core shaft 192 is positioned at the inner peripheral side of the tape roller 106 when viewed in the direction of the core shaft. Although details will be described below, a spring 193 made of a coil spring is incorporated into the core shaft 192 for the purpose of stopping reverse rotation of the tape roller 106.

At the inner periphery of the core shaft 192, a detection object 180 corresponding to the detection portion 51 is provided (see FIG. 6). Although details will be described below, the detection object 180 has a wiring pattern substrate 324 corresponding to the plurality of conductive contacts 51*a* of the detection portion 51. By selective conduction of the plurality of conductive contacts 51*a* due to the wiring pattern substrate 324, a plurality of bit patterns are obtained. That is, these bit patterns correspond to attribute information of the tape cartridge 100 described above.

In the tape accommodation area 190, a tape guide 194 that guides the fed-out printing tape 102 to the platen roller 120 is integrally formed with the lower casing 150 so as to stand in the vicinity of the platen roller 120. That is, inside the cartridge casing 130, a tape feeding path 196 ranging from the tape roll 106 as a starting point to the delivered 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape is further guided from the platen roller 120 to the delivered 138.

The tape roll 106 includes two circular films 198 affixed to both end surfaces of the roll-shaped printing tape 102, besides the printing tape 102 and the tape core 104. The two circular films 198 prevent the printing tape 102 wound on the tape core 104 from spreading out.

The tape core 104 includes a reel portion 104*a* on which the printing tape 102 is wound, and a rolling contact portion 104*c* formed through a plurality of inward ribs 104*b* at an inner side of the reel portion 104*a*. By the rolling contact portion 104*c*, the tape core is rotatably journaled in the core shaft 192. In an end face of the rolling contact portion 104*c*, a plurality of end-face grooves 104*d* are radially formed, and the reverse-rotation stop spring 193 is detachable from the end-face grooves 104*d*. That is, a vertical slit 192*a* extending in a shaft direction is formed at an upper portion of the core shaft 192, and a wire end of the reverse-rotation stop spring 193 protrudes from the vertical slit 192*a* and engages with the end-face groove 104*d* of the rolling contact portion 104*c*.

When the tape cartridge 100 is carried, the reverse rotation of the printing tape 102 is prevented by the reverse-rotation stop spring 193. On the other hand, when the tape cartridge 100 is installed on the cartridge installation portion 5, the reverse-rotation stop spring 193 (see FIG. 9) is compressed by the positioning projection 41, the wire end thereof is separated from the end-face groove 104*d* of the rolling contact portion 104*c*, and the reverse rotation stop is released. Whereby, the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing by the platen roller 120. Moreover, the ink ribbon 110 goes around the opening peripheral wall portion 164 (the plurality of second ribbon guides 212) via the platen roller 120 and is wound up by the winding-up core 116.

Figure 5A:
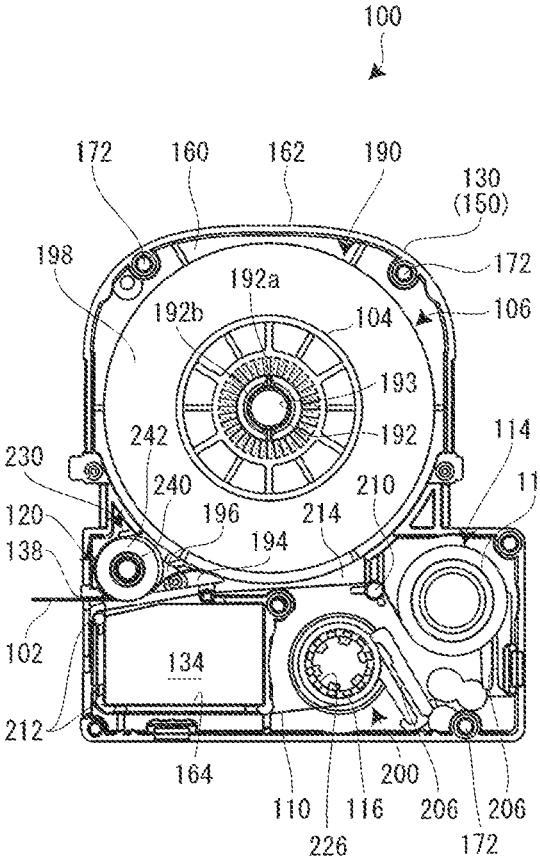
FIGS. 5A and 5B are, respectively, a plan view of the tape cartridge with its upper casing removed and a back view of the upper casing.
Figure 5B:
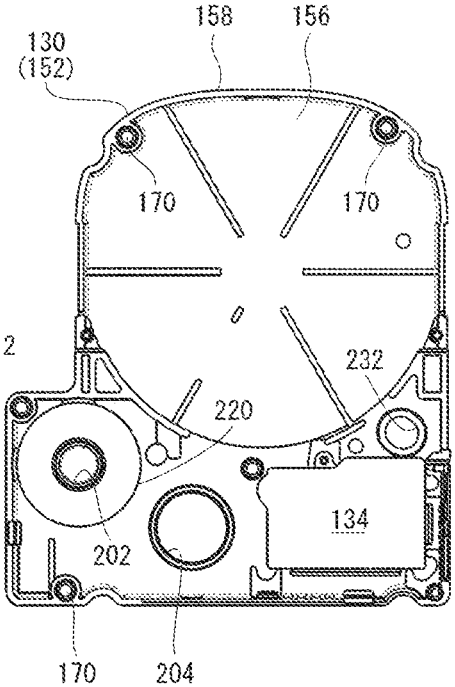

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of them).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical (oval) opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and slightly horizontally movable. That is, the platen roller 120 supported by the elliptical upper bearing portion 232 and the lower bearing portion 234 is configured to be horizontally movable (slightly movable) between a home position at which the platen roller 120 engages with the platen driving shaft 45 and a holding position at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the delivered 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the delivered 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the rotation driving shaft 49 of the platen driving shaft 45. Thus, the rotation force of the platen driving shaft 45 is transmitted to the platen roller 120 to print-feed the printing tape 102 (and the ink ribbon 110).

[Details of Detection Object and Detection Portion]

Figure 7:
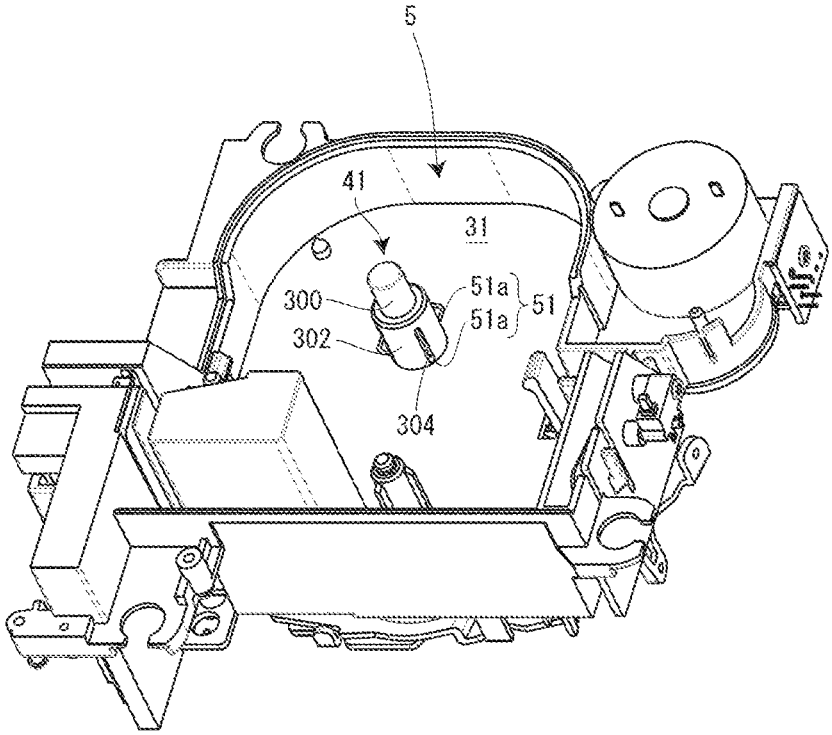
FIG. 7 is a perspective view of the cartridge installation portion.
Figure 8:
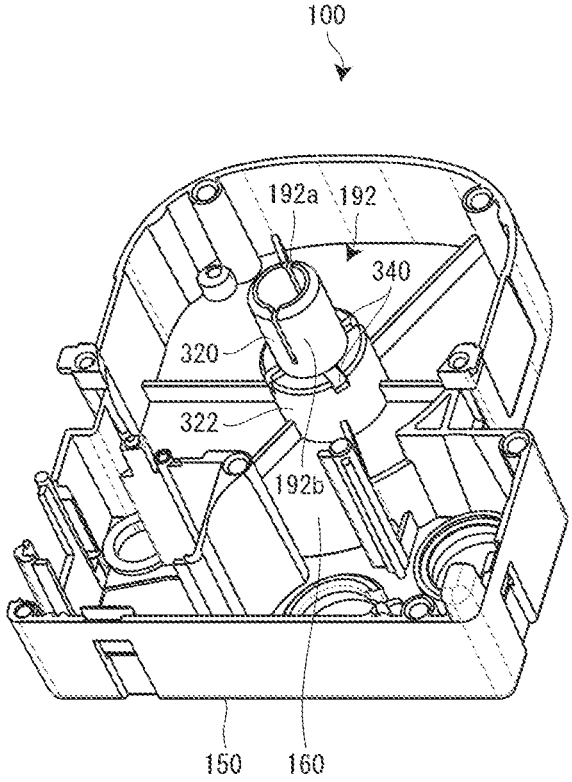
FIG. 8 is a perspective view of a lower casing of the tape cartridge.

Next, with reference to FIGS. 7 and 9, the periphery structure of the detection objet 180 of the tape cartridge 100 will be described in detail with the structure of the detection portion 51 of the cartridge installation portion 5. FIG. 7 is a perspective view of a cartridge installation portion 5, FIG. 8 is a perspective view of the lower casing 150 of the circumference of the tape cartridge 100, and FIG. 9 is an enlarged cross-sectional view of the detection part 51 and the detection unit 180 which are in a state of installing a tape cartridge 100 to a cartridge installation portion 5.

As illustrated in these figures, a positioning projection 41 (convex portion) of the cartridge installation portion 5 is provided with a plurality (4 in the drawings) of the detection portion 51 composed of a conductive contact 51*a*. On the other hand, with respect to the detection portion 51, the detection object 180 is provided in the inner periphery (concave portion) of the core shaft 192 of the tape cartridge 100.

Figure 9:
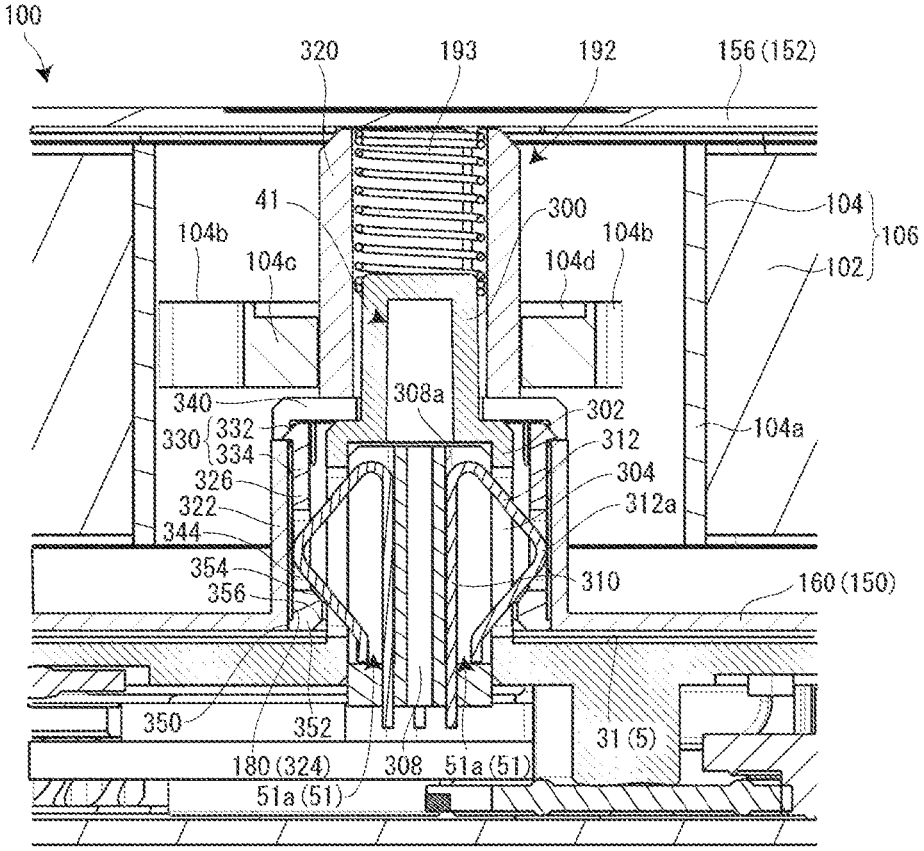
FIG. 9 is an enlarged cross-sectional view of the circumference of a detection portion and a detection object in a state where the tape cartridge is installed on the cartridge installation portion.

As illustrated in FIGS. 7 and 9, the positioning projection 41 includes a first convex portion 300 on the distal end side, and a second convex portion 302 on a base end side formed to have proximally large diameter relative to the first convex portion 300. The first convex portion 300 and the second convex portion 302 are integrally formed (molded), and the first convex portion 300 and the second projection 302 are formed (molded) integrally with the installed base 31. The first convex portion 300 is formed in a cylindrical shape that upper end is closed, and is fitted into the first concave portion 320 of the core shaft 192 to be described later in a state of installing the tape cartridge 100 to the cartridge installation portion 5. In addition, by the fitting, the first convex portion 300 is pushing up (compressing) the reverse stop spring 193 in a state that an end of the reverse stop spring 193 is abutted to the upper casing 152 (the top wall 156), to cancel the reverse stop of the tape roll 106.

The second convex portion 302 is formed in a cylindrical shape, and is loosely fitted into the second concave portion 322 of the core shaft 192 to be described later in a state of installing the tape cartridge 100 to the cartridge installation portion 5. The detection portion 51, which consists of four conductive contacts 51*a*, is incorporated in the second convex portion 302. Further, on the second convex portion 302, four slit openings 304 are formed so as to uniformly be arranged in the peripheral direction. Each slit aperture 304 extends axially, and four conductive contacts 51*a* protrude outward in the radial direction from the four slit openings 304.

Figure 10:
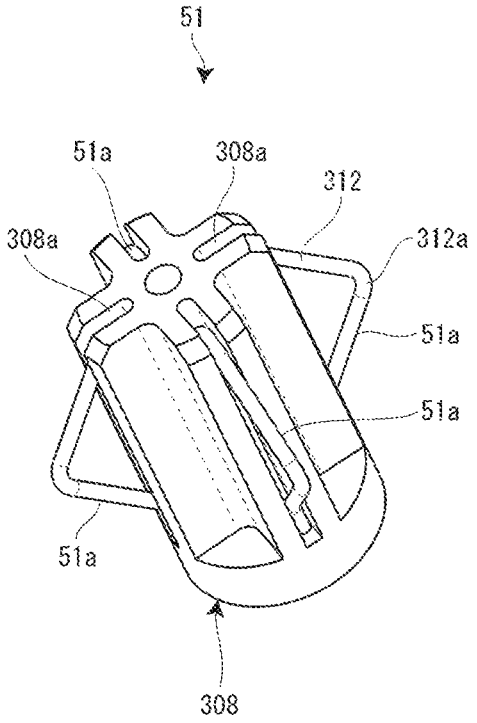
FIG. 10 is a perspective view of an insulating holder and a conductive contact held in the insulating holder.

As illustrated in the FIGS. 9 and 10, the four conductive contacts 51*a* are held by an insulated holder 308 fitted and installed inside the second convex portion 302, in a state where the four conductive contacts are arranged radially (equally arranged in peripheral direction). In the insulated holder 308, four holding grooves 308*a* are formed so as to be equally arranged in peripheral direction. Each of holding grooves 308*a* extends in the axial direction of the tape detection portion 51, and the four holding grooves 308*a* hold the four conductive contacts 51*a*.

Each of the conductive contacts 51*a* is formed from a conductive metal wire having a spring characteristic, and includes a linear portion 310 held in the holding groove 308*a* and a contactor body 312 extended from the upper end of the linear portion 310 in a curved manner forming a nearly reversed chevron shape. The contactor body 312 is bent, and a bent tip portion 312*a* is formed therein. This bent tip portion is formed to be contact with a contact terminal 370 of the detection target 180 to be described. And, the linear portion 310 is connected to the detection circuit (not illustrated), by which the binarized attribute information of the tape cartridge 100 is detected.

In a state where the tape cartridge 100 is installed in the cartridge installation portion 5, the conductive contacts 51*a* and the detection target 180 are positioned to face each other, the conductive contacts 51*a* exhibits a spring force toward the detection target 180, and the conductive contacts 51*a* are resiliently engaged with the detection target 180. The four conductive contacts 51*a* are arranged symmetrically in pairs. Accordingly, the spring force of the four conductive contacts 51*a* are compensated with each other in the detection target 180 subjected to the spring force. Therefore, even though the tape cartridge 100 is subjected to the spring force of the conductive contacts 51*a* through the detection target 180, the displacement thereof is not occurred. Also, the conductive contacts 51*a* may be formed from a strip-like metal material having a spring force. The spring force of the conductive contacts 51*a* can be adjusted with the function of fixing the tape cartridge 100 in the core shaft 192. By fixing the core shaft 192, which is the center position of the tape core 104 wound with the printing tape 102, which is the heaviest component accommodated in the tape cartridge 100, among the components such as the printing tape 102 and the ink ribbon 110, the displacement of the tape cartridge 100 during printing operation can be effectively suppressed.

As illustrated in FIGS. 8 and 9, the core shaft 192 of the tape cartridge 100 includes a first concave portion 320 on the tip side corresponding to the first convex portion 300 and a second concave portion 322 on the base side corresponding to the second convex portion 302. The first concave portion 320 is integrally formed (molded) with the second concave portion 322, and these the first concave portion 320 and the second concave portion 322 are integrally formed (molded) with a bottom case 150 (a bottom wall part 160). In addition, the second concave portion 322 is formed to have a larger diameter than the first concave portion 320.

The first concave portion 320 is formed in a cylindrical shape, and in which the outer periphery on the base side thereof is rotatably engaged with the tape core 104. And, the upper end of the first concave portion 320 reaches the vicinity of a top case 152 (a top wall part 156), and in the inner periphery of the first concave portion 320, the spring 193 for non-return is charged (with reference to FIG. 9). In addition, in a state where the tape cartridge 100 is installed in the cartridge installation portion 5, the first convex portion 300 is fitted and installed to the inner periphery on the base side of the first concave portion 320. Accordingly, the tape cartridge 100 is positioned in the first convex portion 300 through the first concave portion 320, that is, the cartridge installation portion 5.

The second concave portion 322 is formed in a cylindrical shape, and in the inner periphery thereof, the detection target 180 configured with a wiring pattern substrate 324 and a substrate cover 326 covering the wiring pattern substrate 324 are embedded (with reference to FIG. 9). In this case, the wiring pattern substrate 324 is disposed to be held between the outer peripheral surface of the substrate cover 326 and the inner peripheral surface of the second concave portion 322. In addition, the substrate cover 326 is installed in the second concave portion 322 in a snap-in type.

Figure 11A:
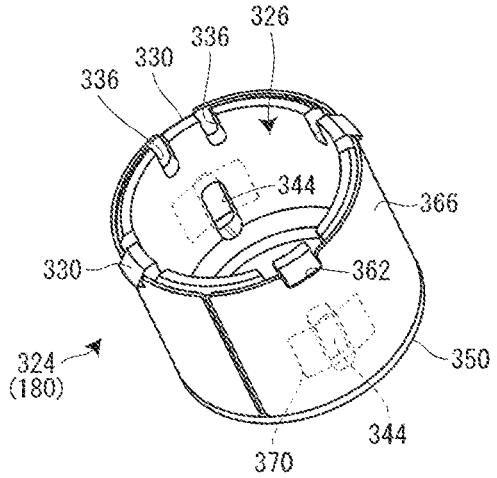
FIGS. 11A and 11B are a perspective view and an exploded perspective view of a wiring pattern substrate and a substrate cover, respectively.
Figure 11B:
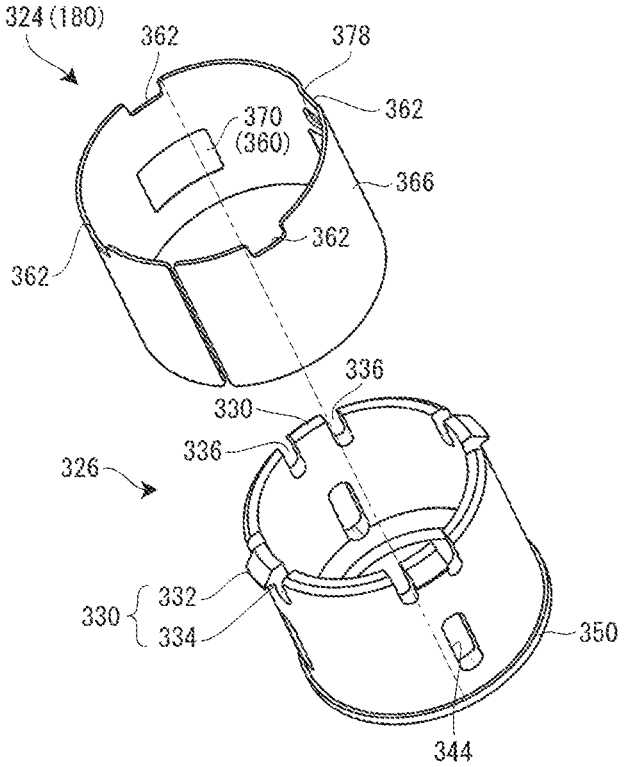

As illustrated in FIG. 9 and FIGS. 11A and 11B, the substrate cover 326 is formed in a cylindrical shape, and in the tip portion thereof four hooks 300 are formed for snap-in. The four hooks 330 are arranged at uniform intervals in peripheral direction. Each of the hooks 300 is integrally formed with a hook body 332 protruding outward and a hook spring portion 334 supporting the hook body 332. In addition, the hook spring portion 334 is formed with two cutting removing portion 336 formed to cut from the tip of the substrate cover 326.

On the other hand, corresponding to the four hooks 330, there are four hook receiving holes 340 (hook reception portion) in the tip portion of the second concave portion 322 (with reference to FIG. 8). Each of the hook receiving holes 340 is formed at the substantially same intervals as each of the hooks 330, and is formed to be capable of positioning each of the hooks 330. In a state where the four hooks 330 are positioned in accordance with the four hook receiving holes 340, the substrate cover 326 inserts into the second concave portion 322, and each of the hook spring portions 334 is bent, whereby each of the hooks 330 is engaged with each of the hook receiving hole 340 so as to drop therein. Therefore, the substrate cover 326 is installed in the second concave portion 322 in an extractable state.

In the substrate cover 326, four through-holes 344 corresponding to the conductive contacts 51*a* are formed. Each of the through-hole 344 is formed in a slit shape, extends in the axial direction. In addition, each of the through-holes 344 is arranged at upper and lower intermediate position of the substrate cover 326 in the axial direction, and arranged at the same position as each of the hooks 330 in peripheral direction. In the conductive contacts 51*a* adjacent to the through-holes 344, the bent tip portions 312*a* thereof are in contact with the contact terminals 370 of the wiring pattern substrate 324 (with reference to FIG. 9).

Then, when the tape cartridge 100 is installed in the cartridge installation portion 5, the position of the four conductive contacts 51*a* on the cartridge installation portion 5 side and the position of the four contact terminals 370 on the tape cartridge 100 side are needed to be equal in peripheral direction all the time. Similarly, the position of the four conductive contacts 51*a* and the position of the four through-holes 344 are needed to be equal in peripheral direction. For this reason, the position in peripheral direction of the four hooks 330 of the substrate cover 326 is regulated with the position of the four hook reception holes 340 of the second concave portion 322.

In this embodiment, in peripheral direction, the four conductive contacts 51*a*, the four through-holes 344, the four hooks 330, and the four hook reception holes 340 are arranged so that the respective positions thereof to be equal. In addition, the description in details will be described later, the four contact terminals 370 are arranged in accordance with the position of the four hooks 330 or the position of the four hook reception holes 340 as a standard (referring to FIG. 11B).

On the other hand, the wiring pattern substrate 324 may be attached partially to the outer peripheral surface of the substrate cover 326 using and adhesive or the like. In this case, the adhesive layer on the back side is no longer needed, and the wiring pattern substrate 324 together with the substrate cover 326 can be easily installed in the second concave portion 322.

As illustrated in FIG. 9 and FIGS. 11A and 11B, in the base portion of the substrate cover 326 (the lower part of the figure), a fitted projection 350 annularly projecting outward in the outer peripheral surface thereof, and an annular projection 352 annularly projecting inward in the inner peripheral surface thereof are formed respectively. The fitted projection 350 is abutted with the lower end (the lower part of the figure) of the wiring pattern substrate 324 disposed on the outside the substrate cover 326. In addition, the fitted projection 350 is fitted into the base end portion of the second concave portion 322 in a state where the substrate cover 326 is installed in the second concave portion 322. On the other hand, the projecting dimension of the fitted projection 350 corresponds to the thickness of the wiring pattern substrate 324. For this reason, the wiring pattern substrate 324 is kept in the minute clearance between the second concave portion 322 and the substrate cover 326 generated by the fitted projection 350, in a state where the lower end of the wiring pattern substrate 324 is abutted to the fitted projection 350 (is subjected to positioning).

The annular projection 352 is present on the position where the four conductive contacts 51*a* relatively can pass over while being elastically deformed when the tape cartridge 100 is installed in the cartridge installation portion 5. In this case, the tip side and the base end side of the annular projection 352 are formed in a chamfered shape. That is, in the tip side of the annular projection 352, an annular tip-side inclined plane 354 is formed, and in the base end side thereof, an annular base-end-side inclined plane 356 is formed.

When each of the conductive contacts 51*a* relatively passes over, the base-end-side inclined plane 356 elastically deforms the conductive contacts 51*a*. In addition, the tip-side inclined plane 354 imparts the click feeling when the tape cartridge 100 is installed, and prevents the installed tape cartridge 100 from floating using the spring force of the conductive contacts 51*a*.

As illustrated in FIGS. 9, 11A, 11B, 12A, and 12B, the wiring pattern substrate 324 is configured by a flexible printed circuit (FPC) and the like, and is attached to the inner peripheral surface of the second concave portion 322. In the wiring pattern substrate 324 in the developed state, a wiring pattern 360 is formed on the front side thereof and an adhesive layer (not illustrated) is formed on the back side thereof (refer to FIG. 12B). For this reason, the wiring pattern substrate 324 is bent in a cylindrical shape so that the front side to be inner side and the back side to be outer side, and adhered to the inner peripheral surface of the second concave portion 322. At the time of actual adhering of the wiring pattern substrate 324 to the second concave portion 322, the wiring pattern substrate 324 is wound to the outer peripheral surface of the substrate cover 326, and is installed and attached to the second concave portion 322 together with the substrate cover 326.

The length of the wiring pattern substrate 324 is formed to be slightly shorter than the peripheral length in the inner peripheral surface of the second concave portion 322, and the wiring pattern substrate 324 attached to the second concave portion 322 in which the end portions are disposed not to be overlapped each other (refer to FIG. 11A). In addition, the portions in the wiring pattern substrate 324 corresponding to the four hook reception holes 340 of the second concave portion 322, that is, the portions corresponding to the four hooks 330 of the substrate cover 326, have four cutout concave portions.

The four cutout concave portions 362 are formed to escape from the four hooks 330, also serves as a reference position for patterning of the wiring pattern 360. The details thereof will be described later, the four contact terminals 370 in the wiring pattern 360 are patterned so as to be equal to the position of the four hooks 330 (the four cutout concave portions 362) in peripheral direction (refer to FIG. 12B).

In addition, as the wiring pattern substrate 324, instead of FPC, it may use a substrate in which the conductive wiring pattern 360 and contact terminal 370 are formed flexibly, for example, a sheet material such as paper or the resin film, the wiring pattern 360 is printed thereon using conductive ink, a sheet material the wiring pattern 360 is metal deposited thereon, a metal foil in which the wiring pattern 360 is remained and on which the printing using insulating ink materials is subjected.

Figure 12A:
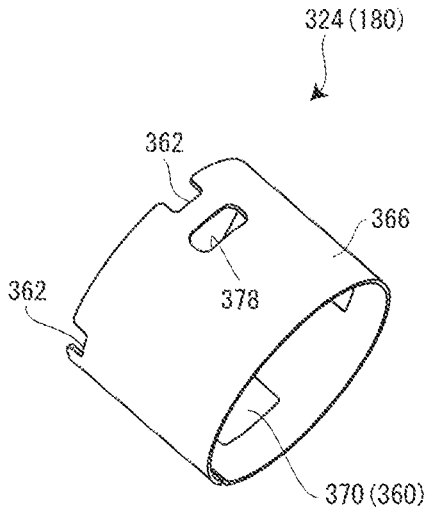
FIGS. 12A and 12B are a perspective view and a developed plan view of a wiring pattern substrate, respectively.
Figure 12B:
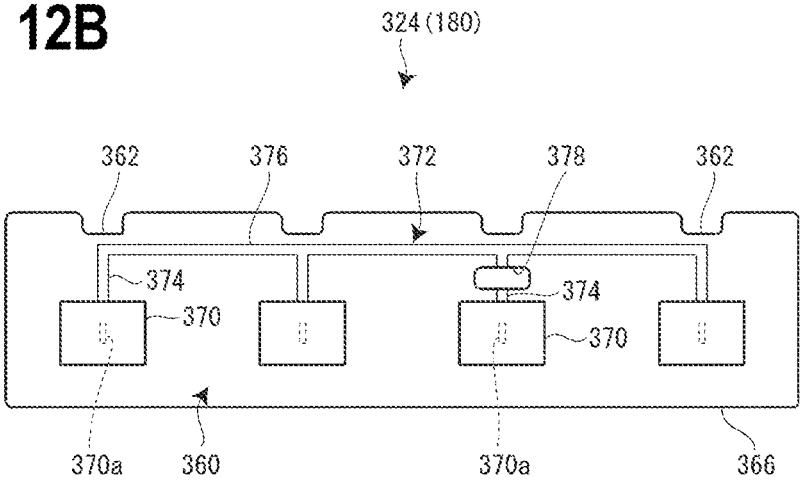

As illustrated in FIGS. 12A and 12B, in the wiring pattern substrate 324 configures the detection target 180, the wiring pattern 360 configuring the attribute information of the tape cartridge 100 are formed on the base substrate 366. The wiring pattern 360 includes the four contact terminals 370 having contact portion 370*a*, which contacts with the four conductive contacts 51*a*, and a conduction/non-conduction wiring portion 372 connected to the four contact terminals 370. In addition, the conduction/non-conduction wiring portion 372 includes four individual wiring portions 374 connected to each of the four contact terminals 370 and a common wiring portion 376 connected to the four individual wiring portions 374, and the conduction/non-conduction of the four individual wiring portions 374 configures the attribute information of the tape cartridge 100.

Each of the contact terminals 370 and each of the individual wiring portions 374 are arranged at the same position as each of the cutout concave portions 362 in a peripheral direction. In addition, each of the contact terminals 370 is patterned widely and rectangularly at the position equal to the through-hole 344 of the substrate cover 326.

In this case, the four individual wiring portions 374 constitute 24=16 bit patterns, that is, 16 kinds of attribute information through individual conduction/non-conduction. Here, when the detection portion 51 and the detection object 180 also perform installation detection of the tape cartridge 100, the kinds of actual attribute information are $2^4-1=15$ since the tape cartridge 100 may not detect the installation in the non-conductive pattern of all of the four individual wiring portions 374. Additionally, when a unit that detects the installation of the tape cartridge 100 is provided, 16 kinds of attribute information can also be allocated to the bit patterns.

On the other hand, the non-conduction according to the embodiment is constituted by removing some of the desired individual wiring portions 374 among the four patterned individual wiring portions 374. That is, in the wiring pattern 360 (the wiring pattern substrate 324) which is the original pattern, the four individual wiring portions 374 are in the conductive state in which the individual wiring portions 374 are connected to the four contact terminals 370. In the original pattern, punch holes 378 are formed in the base substrate 366 through laser processing or punch processing and some of the individual wiring portions 374 are set to be non-conductive.

In the detection circuit connected to the four conductive contacts 51*a*, one of 15 kinds of bit patterns (attribute information) is detected and the kind of tape cartridge 100 is detected.

Modification Examples of Detection Object

Figure 13A:
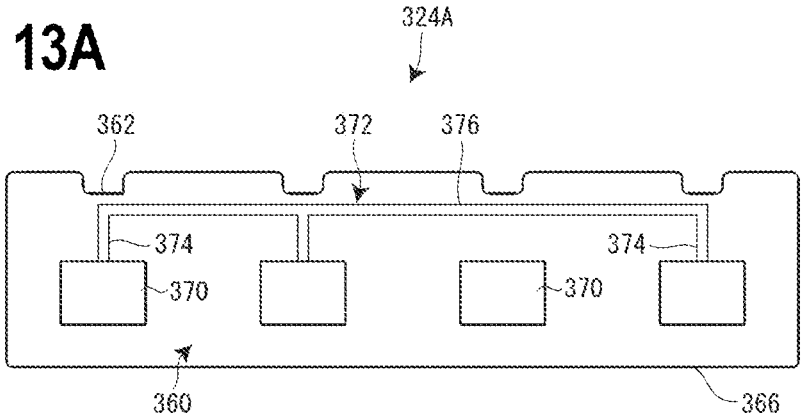
FIG. 13A is a developed plan view illustrating a wiring pattern substrate according to a first modification example.
Figure 13B:
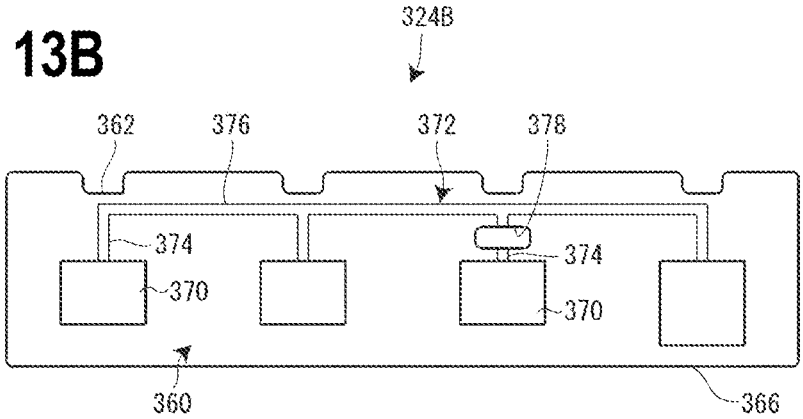
FIG. 13B is a developed plan view illustrating a wiring pattern substrate according to a second modification example.
Figure 13C:
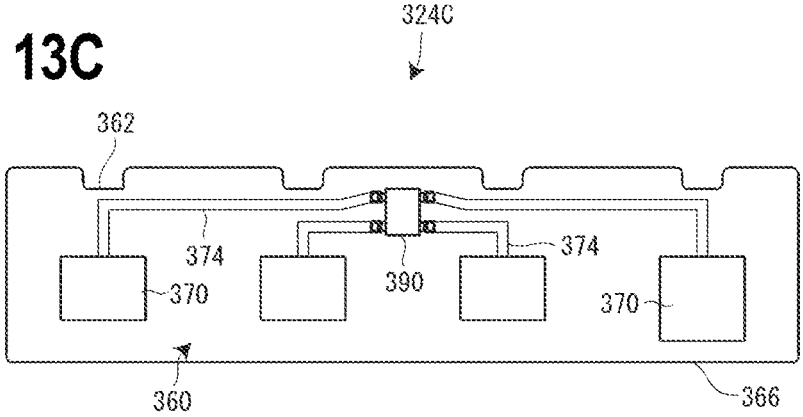
FIG. 13C is a developed plan view illustrating a wiring pattern substrate according to a third modification example.

Next, modification examples of the wiring pattern substrate 342 (the detection object 180) will be described with reference to FIGS. 13A to 13C. FIG. 13A is a plan view illustrating a wiring pattern substrate 324A according to a first modification example. FIG. 13B is a plan view illustrating a wiring pattern substrate 324B according to a second modification example. FIG. 13C is a plan view illustrating a wiring pattern substrate 324C according to a third modification example.

In the wiring pattern substrate 324A according to the first modification example, as illustrated in FIG. 13A, the desired individual wiring portions 374 are not present among the four individual wiring portions 374 so that the wiring pattern 360 is formed. That is, different kinds of wiring pattern substrates 324A of the wiring pattern 360 are prepared to correspond to the kinds (15 kinds) of the tape cartridge 100. On the other hand, leads (lead lines) corresponding to the individual wiring portions 374 may be adopted and necessary leads may be soldered.

In the wiring pattern substrate 324B according to the second modification example, as illustrated in FIG. 13B, four individual wiring portions 374 and the common wiring portion 376 are constituted with resistance lines. In this case, 15 kinds of bit patterns (pieces of attribute information regarding the tape cartridge 100) are detected as differences of resistance values (current values).

As illustrated in FIG. 13C, in the wiring pattern substrate 324C of the third modification example, an electronic device 390 (the IC chip) is disposed on the wiring pattern 360 on the wiring pattern substrate 324C. In this modification example, there is no a common wiring portion 376 and the individual wiring portions 374 are connected to the electronic device 390. The attribute information for each type of the tape cartridge 100 is stored in the electronic device 390. The detection circuit reads out the attribute information of the electronic device 390 to detect the type of the tape cartridge 100.

In particular, in the third modification example, the two individual wires 374 are used as the power supply line (a ground line and a drive voltage supply line of the electronic device 390), and two other individual wiring portions 374 are used as the transmitting and receiving signal line. Therefore, when not only reading out the attribute information, but also using an EEPROM or a flash memory as an electronic device 390, it is also possible to write the required information. For example, it is possible to overwrite the tape remaining amount of the print tape 102 from the tape printing apparatus 1.

As described above, according to the embodiment, since from the point of view of winding habit of the printing tape 102, the inner peripheral portion of the printing tape has a relatively large diameter, and the detection target 180 (the wiring pattern substrate 324) is embedded in the inner peripheral portion of the core shaft 192 where considers as a dead space, thereby suppressing the enlargement of the tape cartridge 100. Also, the wiring pattern substrate 324 can be relatively large in size. Accordingly, even though a minute displacement occurs in the tape cartridge 100 installed in the cartridge installation portion 5, the detection of the attribute information of the tape cartridge 100 is stably operated without damaging the detection performance of the tape detection portion 51. In addition, when the electronic device 390 is used, further, the tape cartridge 100 having the attribute information with large capacity can be used.

In addition, needless to say, the contact terminal corresponding to the number of the conductive contacts 51*a* is arbitrary.

The invention claimed is:

1. A tape cartridge configured to be detachably installed on a tape printing apparatus provided with a detection portion which detects attribute information of the tape cartridge when the tape cartridge is installed on a cartridge installation portion of the tape printing apparatus, the tape cartridge comprising:

a wound printing tape; and a core shaft, wherein the core shaft is positioned at an inner peripheral side of the wound printing tape, the core shaft includes a detection object which faces the detection portion when the tape cartridge is installed on the tape printing apparatus, and with respect to the detection portion that includes a plurality of conductive contacts connected to a detection circuit of binarized attribute information, the detection object includes:

a plurality of contact terminals including a contact portion that comes in contact with the plurality of conductive contacts when the tape cartridge is installed on the tape printing apparatus;

a conductive/non-conductive wiring portion that is connected to the plurality of contact terminals; and a wiring pattern substrate provided with the plurality of contact terminals and the conductive/non-conductive wiring portion.

2. The tape cartridge according to claim 1, wherein when the tape cartridge is installed on the tape printing apparatus, the detection object engages with the detection portion.

3. The tape cartridge according to claim 2, wherein the detection object and the detection portion elastically engage with each other.

4. The tape cartridge according to claim 1, wherein with respect to the detection portion incorporated into a convex portion provided projectingly at the cartridge installation portion, the core shaft includes a concave portion into which the convex portion is inserted, when the tape cartridge is installed on the cartridge installation portion, and the detection object is incorporated into the concave portion.

5. The tape cartridge according to claim 4, wherein with respect to the convex portion including a first convex portion on a tip end side and a second convex portion on a base end side into which the detection portion is incorporated, the concave portion includes:

a first concave portion that is fitted into the first convex portion; and a second concave portion that faces the second convex portion and is incorporated with detection object.

6. The tape cartridge according to claim 1, wherein the wiring pattern substrate is flexible.

7. The tape cartridge according to claim 6, wherein with respect to the detection portion incorporated into a convex portion provided projectingly at the cartridge installation portion, the core shaft includes a concave portion into which the convex portion is inserted when the tape cartridge is installed on the cartridge installation portion, and the wiring pattern substrate is disposed at an inner peripheral side of the core shaft constituting the concave portion.

8. The tape cartridge according to claim 7, wherein the wiring pattern substrate is disposed at the inner peripheral side of the core shaft constituting the concave portion such that the plurality of contact terminals is located at an inner side.

9. The tape cartridge according to claim 6, wherein the detection object further includes a cylindrical substrate cover that covers the wiring pattern substrate, and the cylindrical substrate cover is formed with a plurality of through-holes that allows each of the plurality of conductive contacts to come in contact with a respective one of the plurality of contact terminals.

10. The tape cartridge according to claim 9, wherein the wiring pattern substrate is attached to an outer peripheral surface of the cylindrical substrate cover.

11. The tape cartridge according to claim 9, wherein the cylindrical substrate cover is installed on an inner peripheral surface of the core shaft in a form of snap-in.

12. The tape cartridge according to claim 11, wherein the cylindrical substrate cover is formed with a hook for the snap-in, and the wiring pattern substrate includes a notched concave portion in a portion corresponding to the hook.

13. The tape cartridge according to claim 11, wherein the cylindrical substrate cover is formed with a hook for the snap-in, and in the inner peripheral surface of the core shaft, a hook receiving portion having a width corresponding to that of the hook is formed.

14. The tape cartridge according to claim 6, wherein the conductive/non-conductive wiring portion of the wiring pattern substrate includes:

a plurality of individual wiring portions that are connected to a respective one of the plurality of contact terminals; and a common wiring portion through which each of the plurality of individual wiring portions are connected to each other, and the attribute information is configured by conduction/non-conduction of the plurality of individual wiring portions.

15. The tape cartridge according to claim 14, wherein the non-conduction is configured by partially removing a desired individual wiring portion from the plurality of individual wiring portions.

16. The tape cartridge according to claim 6, wherein an electronic device is disposed on the wiring pattern substrate.

17. The tape cartridge according to claim 1, wherein with respect to the plurality of conductive contacts disposed at equal intervals in a peripheral direction relative to a convex portion provided projectingly at the cartridge installation portion, the plurality of contact portions of the plurality of contact terminals are disposed at equal intervals in the peripheral direction.

18. The tape cartridge according to claim 17, wherein the detection object further includes a cylindrical substrate cover that covers the wiring pattern substrate, and with respect to the plurality of conductive contacts having spring properties, the cylindrical substrate cover includes an annular projection in which the plurality of conductive contacts relatively get over while being elastically deformed.

19. The tape cartridge according to claim 18, wherein the annular projection has a tip end that is formed in a chamfered shape.

20. A tape cartridge configured to be detachably installed on a tape printing apparatus provided with a detection portion which detects attribute information of the tape cartridge when the tape cartridge is installed on a cartridge installation portion of the tape printing apparatus, the tape cartridge comprising:

a wound printing tape; and a core shaft, wherein the core shaft is positioned at an inner peripheral side of the wound printing tape, the core shaft includes a detection object which faces the detection portion when the tape cartridge is installed on the tape printing apparatus, with respect to the detection portion that includes a plurality of conductive contacts connected to a detection circuit of binarized attribute information, the detection object includes:

a plurality of contact terminals including a contact portion that comes in contact with the plurality of conductive contacts when the tape cartridge is installed on the tape printing apparatus; and a conductive/non-conductive wiring portion that is connected to the plurality of contact terminals, and with respect to the plurality of conductive contacts disposed at equal intervals in a peripheral direction relative to a convex portion provided projectingly at the cartridge installation portion, the plurality of contact portions of the plurality of contact terminals are disposed at equal intervals in the peripheral direction.

* * * * *